US005127283A

United States Patent [19]

O'Brien et al.

[11] Patent Number: 5,127,283

[45] Date of Patent: Jul. 7, 1992

[54] HANDBRAKE MECHANISM FOR RAILWAY CARS

[75] Inventors: Raymond A. O'Brien, Forest Park; Edward Reczek, Cicero; Rudi E. George, Forest Park, all of Ill.

[73] Assignee: Westinghouse Air Brake Company, Wilmerding, Pa.

[21] Appl. No.: 647,775

[22] Filed: Jan. 30, 1991

[51] Int. Cl.[5] ..... G05G 1/08

[52] U.S. Cl. ..... 74/505; 192/16; 192/95; 188/33

[58] Field of Search ..... 74/505, 507; 188/33; 192/15, 16, 95, 101

[56] References Cited

U.S. PATENT DOCUMENTS

| | | | |
|---|---|---|---|
| Re. 25,001 | 9/1959 | Bretz, Jr. | 192/16 |
| 3,040,597 | 6/1962 | Bretz, Jr. | 74/505 |
| 3,258,991 | 7/1966 | Bezlaj | 74/505 |
| 3,602,063 | 8/1971 | Koehler | 74/505 |
| 3,714,842 | 2/1973 | Koehler | 74/505 |
| 3,933,225 | 1/1976 | Bretz, Jr. | 188/33 |
| 3,988,944 | 11/1976 | Klasing | 74/505 |
| 4,282,771 | 8/1981 | Grube | 74/505 |
| 4,291,793 | 9/1981 | Klasing | 74/505 X |
| 4,301,693 | 11/1981 | Stanley | 74/505 |
| 4,368,648 | 1/1983 | Housman et al. | 74/505 |
| 4,714,142 | 12/1987 | Shepherd | 74/505 X |

*Primary Examiner*—Richard M. Lorence

*Assistant Examiner*—Benjamin Levi

*Attorney, Agent, or Firm*—James O. Ray

[57] ABSTRACT

A railway car brake mechanism is comprised of a hand wheel on a shaft and a housing with a rotatable gear wheel and square chain winding disposed within. A ratchet wheel rotatable with the hand wheel shaft and a freely rotatable pinion which engages the gear wheel is also provided. The rotatable pinion has a flange with a disengageable driving connection with the gear wheel and a disengageable connection between flange and ratchet wheel. The main gear wheel and chain winding drum comprise a main gear wheel assembly. The assembly is attached by a chain end link through an interconnection of the main gear wheel and outwardly extending section of the chain winding drum. To prevent kinking or slippage of the chain, a spiral groove is formed in the square chain drum. The groove enables the chain to be wound within the drum with alternate links seated on a concave surface and intermediate links, which rest on the outer surface of the drum, to be at right angles to the aforementioned alternate links. Further, a trip cam is utilized to rotate a trip bar. The bar disengages the driving connection and permits the pinion to freely rotate the main gear wheel to release the brake. Specifically, the trip cam has a shaft with both a cam arm and safety arm. With respect to the cam arm and shaft of the trip cam, the safety arm is located at a substantially 90 degree angle.

48 Claims, 9 Drawing Sheets

HANDBRAKE MECHANISM FOR RAILWAY CARS

CROSS REFERENCE TO CO-PENDING APPLICATIONS

This application is related to application Ser. No. 648,233, filed in the names of the present inventors, on even date herewith, entitled "Main Gear Assembly For Winding a Chain Thereon"; and to Application Ser. No. 647,781, filed on even date herewith, entitled "Trip Cam", filed in the name of Edward Reczek, both said applications are assigned to the assignee of the present invention, and both of said applications being incorporated by reference herein.

FIELD OF THE INVENTION

The present invention relates to a handbrake mechanism for railway cars, and more specifically to a handbrake mechanism for railway cars that uses a chain winding drum to wind a chain thereon to activate the brake and uses a trip cam which cooperates with a trip bar to disengage an operational connection between a flange on a pinion and a ratchet wheel, with the trip cam preventing such disengagement when the trip cam occupies its nonoperative position.

BACKGROUND OF THE INVENTION

Handbrake mechanisms for applying and releasing the handbrake of a railway car have been in wide use. Examples of such handbrake mechanisms and improvements thereon are described in U.S. Pat. No. 3,040,597 to Frank E. Bretz, Jr. issued Jun. 10, 1962; U.S. Pat. No. 3,602,063 to William F. Koehler, issued Aug. 31, 1971; U.S. Pat. No. 3,714,842 to William F. Koehler, issued Feb. 6, 1973; and U.S. Pat. No. 3,933,225 to Frank E. Bretz, Jr., issued Jun. 10, 1974, the contents of these four patents being incorporated by reference herein.

U.S. Pat. No. 3,040,597, describes a handbrake mechanism for use with railway cars that has a combination of a rotary chain winding drum and a main gear wheel, with a rotatable hand wheel shaft having a bearing section at one end and a hand wheel receiving section at the other end. A ratchet wheel is provided intermediate the ends of the shaft and is rotatable with the shaft, and a ratchet pawl cooperates with the ratchet wheel to prevent reverse rotation of the ratchet wheel. A pinion is freely rotatably mounted on the bearing section of the shaft which engages the main gear wheel, the pinion having a radially extending flange rotatable cojointly therewith. A disengageable driving connection between the flange and the ratchet wheel is provided. A rotatably mounted trip bar cooperates with the flange to move the flange to disengage the driving connection with the ratchet wheel, so as to permit the pinion to freely rotate and release the main gear wheel for rotation in a brake releasing direction. A rotatably mounted trip cam cooperates with the trip bar to rotate the trip bar for shifting the flange, and an arm on the trip cam is arranged and adapted to overlie the flange and prevent shifting of the flange out of operational connection with the ratchet wheel when the trip cam occupies its nonoperative position. The trip cam described in U.S. Pat. No. 3,040,597 is formed as a shaft with journaled ends, one of which ends is noncircular. A cam arm extends radially from the shaft, which cam arm engages a flange on a trip lever of the trip bar to shift the flange on the pinion and permit the chain to unwind from the chain winding drum to release the brakes. A safety arm is formed integrally with the shaft of the trip cam and normally extends in overlying relation with the flange on the pinion, the safety arm having a flared end which facilitates movement into a position where the safety arm is positioned to prevent movement of the flange on the pinion out of driving connection with the ratchet wheel. When the trip cam is rotated to move the cam arm into operative engagement with a blange on the trip bar, the safety arm is moved out of the path of the flange on the pinion and it is permitted to move, so as to provide for release of the ratchet wheel.

In U.S. Pat. No. 3,602,063, a handbrake mechanism is described having a square chain-winding drum. The square drum has a radial flange that is secured by rivets to a main gear, both of which are rotatably mounted on a shaft extending between a cover and a brake plate of a handbrake mechanism case. The square drum has an outer square configuration and an inner square configuration tangentially related to the outer square configuration. Alternate links of a chain are arranged to lie flatwise along the sides of the outer configuration while the intermediate links are positioned along the sides of the inner square configuration and at right angles to the axis of rotation of the square drum. Radially extending ribs having flat outer surfaces are formed at the ends of the sides of the inner square configuration, with concave end portions of the sides of the inner square configuration extending along the sides of the ribs which conform to the configuration of juxtaposed end portions of the intermediate links of the chain. The end of the chain opposite the end which is attached to the brake rigging is connected, in one embodiment, using a two-way handbrake mechanism, by a pin to a chain anchor that is secured to the case of the handbrake mechanism. In another embodiment, using a quick release handbrake mechanism, that end is connected to a shock-absorbing anchor means including an angle bracket bolted to the car frame, such as an end sill or other frame part of the car with which the braking mechanism is used.

In U.S. Pat. No. 3,714,842, an improvement over the handbrake shown in U.S. Pat. No. 3,040,597, is described where the trip bar of the handbrake mechanism uses a tie bar having a lever at each end for releasing the driving combination between the ratchet wheel and the gear wheel rotatable with a chain winding drum. Each lever has a pivot aperture for receiving a pivot pin that extends inwardly from the housing side wall. Each pivot also has an annular groove for receiving a U-shaped slot in a plate-like pin keeper adjacent the respective side wall of the housing to hold the pivot pin in operative position. Each keeper pin has a cylindrical spring guide to receive a coil compression spring that biases the respective lever to maintain the driving connection.

U.S. Pat. No. 3,933,225 discloses a similar railway car handbrake mechanism that uses one or more blocks of a compressible shock absorbing solid material or a compressible shock-absorbing spring to absorb the kinetic energy shock incident to the trip release of the chain under tension. The shock-absorbing device is located in the brake mechanism housing, in the path of the chain when the brake is released. The chain is prevented from winding in the wrong direction and causing damage to the handbrake mechanism at one end of the chain and brake components at the other end of the chain.

OBJECTS OF THE INVENTION

It is an object of the present invention to provide a handbrake mechanism for a railway car that provides for a quick release of the handbrake by quick release of a chain wound about a chain drum, using a horizontally extending trip lever, to release the brake.

It is another object of the invention to provide a hand brake mechanism for a railway car where the chain is wound on a square chain drum without any overlapping of links of the chain on the drum, to permit quick release of the chain from the drum to release the brake.

It is yet another object of the present invention to provide a hand brake mechanism for a railway car where a spiral groove is formed in the square chain drum, so as to enable winding of the chain on the drum without kinking of the links of the chain during the winding of the chain on the drum, to permit quick release of the chain from drum to release the brake.

It is a further object of the present invention to provide a handbrake mechanism for a railway car where the housing of the brake mechanism is constructed so as to accept a square chain drum having a spiral groove therein for winding of a chain, such that a quick release of the chain from the drum is effected.

It is yet a further object of the present invention to provide a handbrake mechanism for a railway car having an improved trip cam that is connected to a horizontally extending trip lever for quick release of a chain wound about a chain drum to release the brake.

It is an additional object of the present invention to provide a handbrake mechanism for a railway car having a trip cam of a particular geometric configuration, so as to provide a quick release of a chain wound about a chain drum to release the brake.

SUMMARY OF THE INVENTION

A railway car handbrake mechanism has a hand wheel that is used to rotate a gear wheel to apply the brakes, and a housing having a back wall and a front wall, with a chain winding drum and a main gear wheel rotatably mounted on the housing. A hand wheel shaft is also rotatably mounted on the housing and has a bearing section at one end and a hand wheel receiving section on the other end external to the housing. A ratchet wheel is rotatable with the shaft intermediate the ends of the shaft and a pawl provided which cooperates with the ratchet wheel so as to prevent reverse rotation of the ratchet wheel. A freely rotatable pinion on the shaft engages the main gear wheel, the pinion having a radially extending flange cooperating therewith. A disengageable driving connection is provided between the radially extending flange and the ratchet wheel. A trip cam is rotatably mounted in the housing and a trip bar, operable by the trip cam, cooperates with the radially extending flange to move the flange to disengage the driving connection and permit the pinion to freely rotate the main gear wheel for rotation in a brake releasing direction, accompanied by release of the chain winding drum and a chain wound on the chain winding drum to release the railway car handbrake.

The main gear wheel and chain winding drum comprise a main gear assembly, having a circular gear plate with gear teeth about its periphery, a central passageway through the gear plate, for mounting on a shaft, and a substantially square chain drum upon which the chain is wound. The square chain drum has a longitudinal axis with a reduced diameter trunion at one end that is secured in the central passageway of the main circular gear plate. A shaft bore is provided through the square chain drum along its longitudinal axis and a drum shaft is mounted with a first end journaled in a back wall of the housing, such that the main gear assembly is freely rotatably mounted on the drum shaft. The front wall of the housing preferably has an upper section, an intermediate section extending outwardly therefrom away from the back wall, and a lower section extending downwardly from the intermediate section, with the drum shaft extending between the back wall and the lower section of the front wall.

An outwardly extending pin section extends away from the square chain drum in a direction transverse to the longitudinal axis, the outwardly extending pin section having a chain fastener pin aperture therethrough which is substantially parallel to the longitudinal axis of the square chain drum. A chain fastener pin, which passes through a first end link of the chain, attaches the chain to the main gear assembly, the chain fastener pin being secured in the aperture through the outwardly extending pin section, with the first end link secured between the outwardly extending pin section and the main circular gear plate.

Preferably, the outwardly extending pin section is secured to the square chain drum and has a first flange that extends away from the square chain drum and a chain seat member that extends between the first flange and the main circular gear plate. A second flange may be provided adjacent the main circular gear plate, spaced from and aligned with the first flange, which extends from the distal end of the chain seat member back towards the square chain drum. The main circular gear plate preferably has an opening therein, coaxial with the aperture through the outwardly extending pin section on the square chain drum, and an end of the chain fastener pin is secured in the opening in the main circular gear plate.

The trip cam used to rotate the trip bar which cooperates with the radially extending flange, so as to disengage the driving connection and permit the pinion to freely rotate the main gear wheel for rotation in a brake releasing direction, comprises a shaft, having a longitudinal axis, first and second journaled ends, and an intermediate section. A cam arm extends radially outwardly from the intermediate section, as does a safety arm, spaced from the cam arm, which safety arm has a flared portion on the end thereof that provides an end face.

The trip cam is constructed to provide a substantially 90° angle between a first plane drawn through the longitudinal center of the cam arm and the longitudinal axis of the shaft, and a second plane drawn along the end face of a shoulder of the flared portion of the safety arm end.

The trip cam is preferably formed as a one piece forged steel component, and also has a flat face on the first journaled end, with the flat face along the first journaled end disposed along a third plane that is substantially 135° offset from the second plane drawn along the end face of the shoulder of the flared portion of the safety arm end.

DESCRIPTION OF THE DRAWINGS

The invention will become more readily apparent from the following description of the preferred embodiments thereof shown, by way of example only, in the accompanying drawings, wherein.

DETAILED DESCRIPTION

Figure 1:
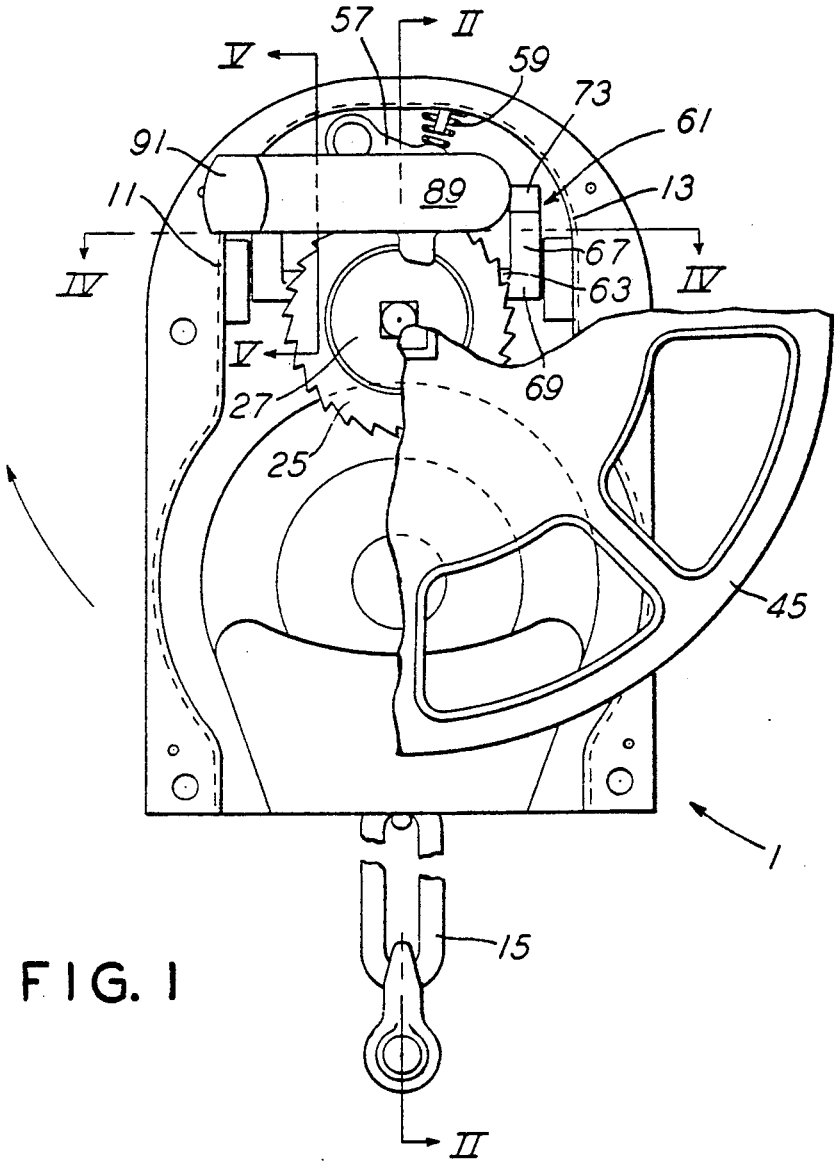
FIG. 1 is a front elevational view of a railway car handbrake mechanism of the present invention, with portions broken away to show certain internal components.
Figure 2:
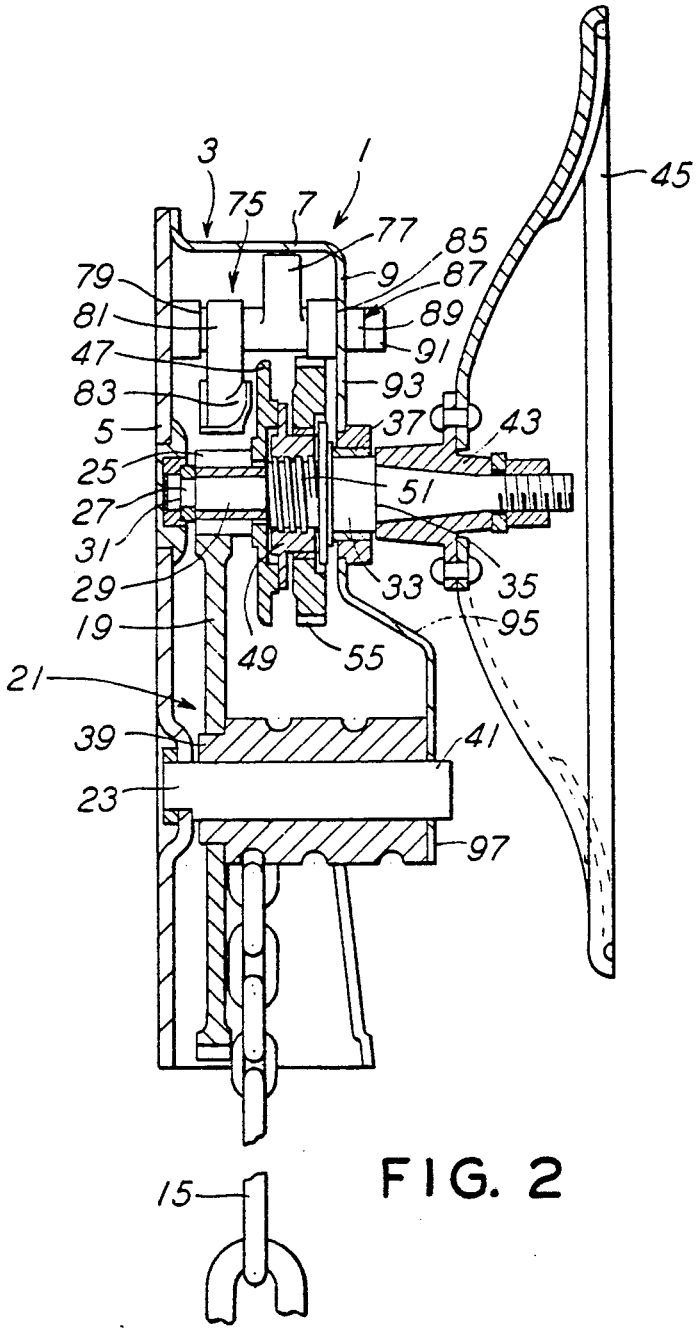
FIG. 2 is a vertical sectional view taken along lines II-II of FIG. 1.

Referring now to FIGS. 1-5, a handbrake mechanism 1 is shown, having operative parts such as are disclosed and described in the previously mentioned patents that have been incorporated by reference herein, but modified according to the present invention. The brake mechanism 1 has a housing 3 which comprises a back plate or wall 5, mountable on a railway car, and a cover 7, the cover 7 formed as a front wall 9 and side walls 11 and 13, which cover 7 is secured to the back wall 5.

A chain 15, for application or release of the brakes, is connected, as is conventional, to the brake rigging, which chain 15 is attached to and wound on a square chain winding drum 17 that is secured to a main circular gear plate 19, so as to form a main gear assembly 21. The square chain winding drum 17 is journaled on a drum shaft 23. The main gear assembly 21 is arranged so as to be driven by a pinion 25, which is freely rotatably mounted on a reduced diameter section 27 of a hand wheel shaft 29. The hand wheel shaft 29 is journaled at a first end 31 thereof on the back wall 5 of the housing 3 and has a bearing portion 33 adjacent a second end 35 which is journaled in a bushing 37 mounted on the front wall 9 of the housing 3. The drum shaft 23 is also mounted with a first end 39 journaled in the back wall 5 and the second end 41 in the front wall 9 of the housing 3. The outer second end of the hand wheel shaft 29 has a hand wheel receiving section 43, external to the housing 3, to which a hand wheel 45 is secured.

A driving connection is provided between the hand wheel 45 and the pinion 25 by a radially extending flange 47 on pinion 25. As described in the aforementioned patents incorporated herein, provision is made for mechanically engaging the radially extending flange 47 and a pressure nut 49 which is mounted on a threaded section 51 of the hand wheel shaft 29. A brake flange 53, is integral with the hand wheel shaft 29. Located between the hand wheel shaft 29 and the pressure nut 49 is a ratchet wheel 55. A pawl 57 is provided to prevent the ratchet wheel 55 from reverse rotation, which pawl 57 is biased into operative position for engagement with the ratchet wheel 55 by a spring 59.

In order to apply the brakes, the hand wheel 45 is rotated clockwise as viewed in FIG. 1. Since some tension is applied to the chain 15, there will be some resistance to rotation by the pinion 25 and the pressure nut 49, and such hand wheel rotation against this tension causes the pressure nut 4 to rotate slightly along the threaded section 51 of the hand wheel shaft 29. The ratchet wheel 55 is thus clamped between the pressure nut 49 and the brake flange 53, and as long as the brake flange 53 maintains mechanical connection to the pressure nut 49, the driving connection to the pinion 25 is maintained, with any reverse rotation prevented by the pawl 57.

In order to quickly release the brakes by shifting the radially extending flange 47 out of engagement with the pressure nut 49, for interrupting the driving connection between the hand wheel shaft 29 and the pinion 25, a trip bar 61 is provided which is formed as a tie bar 63 having levers 65 and 67 at the ends thereof, the levers 65 and 67 having jaws 69 and 71. The jaws 69 and 71 engage opposite sides of the radially extending flange 47, and shift the radially extending flange 47 into or out of engagement with the pressure nut 49 for controlling the driving engagement between the hand wheel shaft 29 and the pinion 25. Coil compression springs between the back wall 5 and the jaws 69 and 71 bias the radially extending flange 47 into driving engagement with the pressure nut 49. To manually shift the trip bar 61 and displace the radially extending flange 47 from driving engagement with the pressure nut 49, a lever 67 is provided with a lever arm 73 having a lateral flange thereon. A trip cam 75 is arranged to contact the lateral flange of the lever arm 73, through a cam arm 77 that extends radially from the cam shaft 79. The rear end of cam shaft 79 is journaled in a bearing secured to the back wall 5, while the front end is journaled in a bearing carried by the front wall 9 of the housing 3. A radially extending safety arm 81 on the cam shaft 79 has a flared end 83, which prevents inadvertent disengagement of the radially extending flange 47 from driving engagement with the pressure nut 49. A journaled forward end 85 of the cam shaft 79 extends through the front wall 9 of the cover 7, which has mounted thereon a manually operable trip lever 87. Movement of the trip lever 87 in a clockwise direction pivots the trip cam 75 to move the flared end 83 out of the path of the radially extending flange 47, while the cam arm 77 engages the lateral flange of the lever arm 73 and pivots the trip bar 61. The jaws 69, 71 move the radially extending flange 47 laterally of the pinion 25 and away from mechanical engagement with the pressure nut 49. The chain 15 is thus permitted to rapidly unwind from the chain winding drum 17 to immediately release the brakes fully and completely, while the pawl 57 continues to prevent reverse rotation of the ratchet wheel 55.

The trip lever 87 has a horizontal portion 89 which is mounted on the forward end 85 of the cam shaft 79, with an enlarged grip portion 91 at the end thereof. Movement of the trip lever 87 in a clockwise direction, as indicated by the arrow in FIG. 1, releases the brakes.

The front wall 9 of the cover 7 of the housing 3 has an upper front wall section 93 through which the outer end of the hand wheel shaft 29 extends, with the hand wheel receiving section 43 external to the housing, an intermediate front wall section 95 extending outwardly therefrom away from the back wall 5, and a downwardly extending lower front wall section 97 extending downwardly from the intermediate front wall section 95. The lower front wall section 97 of the front wall 9 is thus positioned further from the back wall 5 than is the upper front wall section 93. The drum shaft 23 is mounted between the back wall 5 and the lower front wall section 97 of the front wall 9 of the housing 3 so as to better accommodate the main gear assembly 21 of the present invention.

In accordance with the present invention, the main gear wheel 19 and chain winding drum 17 comprise a main gear assembly 21 that enables winding of the chain 15 without kinking or entanglement of the chain 15 on the square chain winding drum 17.

Figure 8:
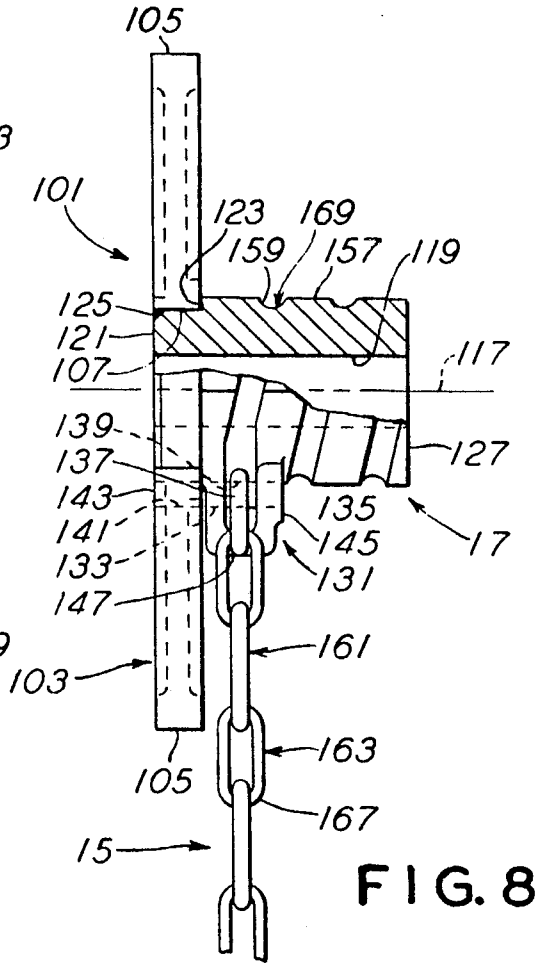
FIG. 8 is a sectional view taken along the lines VIII—VIII of FIG. 6.
Figure 7:
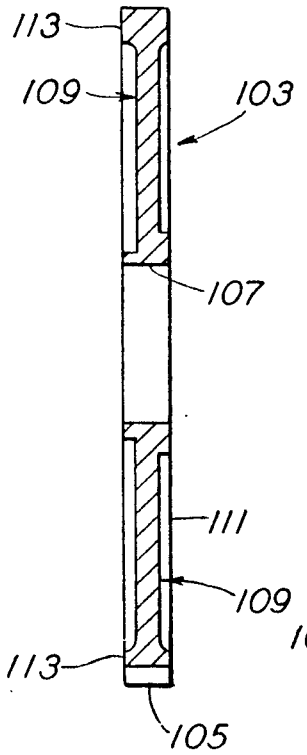
FIG. 7 is a cross-sectional view of the main circular gear plate of the main gear assembly of FIG. 6.
Figure 6:
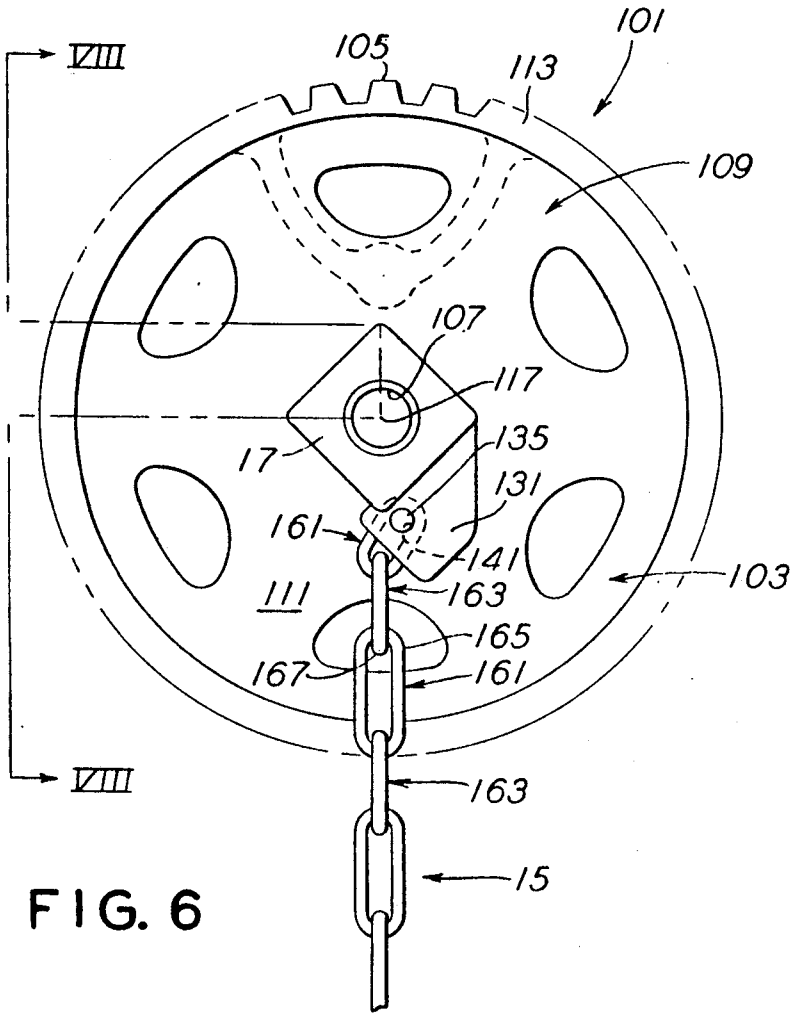
FIG. 6 is an elevational view of the main gear assembly of the railway car handbrake mechanism of the present invention showing the chain attached thereto.

The improved main gear assembly 101, as illustrated in FIGS. 6–8, includes the chain 15, and a main circular gear plate 103 that has gear teeth 105 about the periphery thereof and a central passageway 107 which is formed through the main circular gear plate 103 to allow rotatable mounting of the main circular gear plate 103 on a shaft which passes through the central passageway 107.

As illustrated in FIGS. 6 and 7, the main circular gear plate 103, formed from metal, preferably has a recessed portion 109 provided in each side face 111 which extends from a location adjacent the central passageway 107 to a location adjacent the circumference, with the gear teeth 105 provided on a peripheral enlarged section 113.

Figure 9:
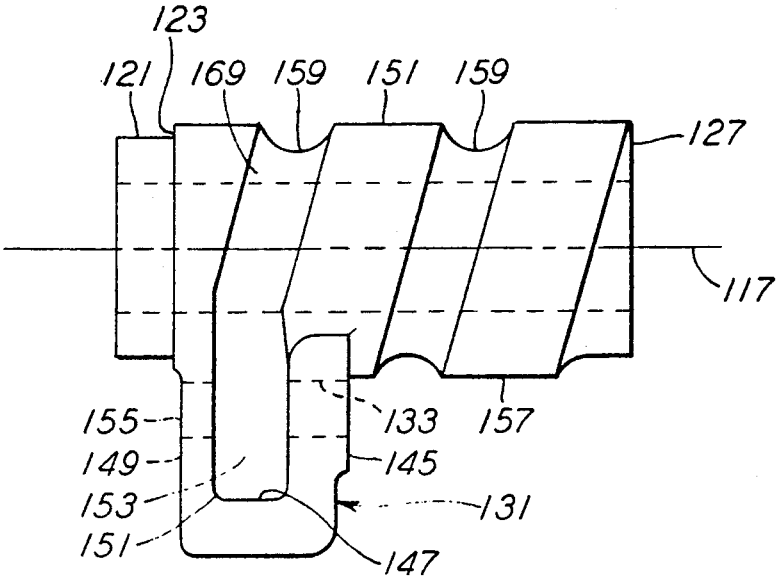
FIG. 9 is an elevational view of the square chain drum of the main gear assembly of FIG. 6.
Figure 10:
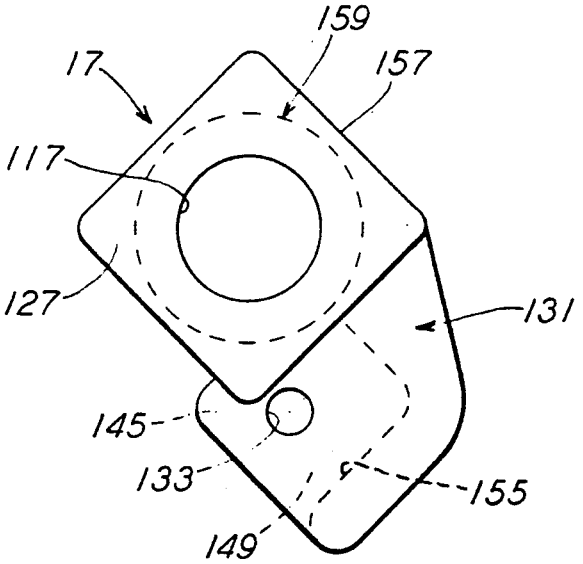
FIG. 10 is an end view, from the opposite end, of the square chain drum shown in FIG. 9.

Secured to the main circular gear plate 103 is the substantially square chain drum 17, illustrated in detail in FIGS. 8-10, upon which the chain 15 is wound on the main gear assembly 101, the square chain drum 17 having a longitudinal axis 117 and a shaft bore 119 through the square chain drum 17 coaxial with the longitudinal axis 117. A reduced diameter trunion 121 is formed on one end 123 of square chain drum 17, which reduced diameter trunion 121 is secured in the central passageway 107 of the main circular gear plate 103, such as by welds 125. The opposite end 127 of the square chain drum 17 need not be of reduced size, while the shaft bore 119 passes completely through both ends 123 and 127 of the square chain drum 17, so as to permit rotatable mounting of the main gear assembly 101 on drum shaft 23. Bushings 131 are provided in both ends of the shaft bore 119 to enhance the rotatable movement of the main gear assembly 101 on the drum shaft 23.

An outwardly extending pin section 131 is provided which extends away from the square chain drum 17 in a direction transverse to the longitudinal axis 117 of the square chain drum 17, and is preferably formed as a single piece unit with the square chain drum 17. An aperture 133 is formed through the outwardly extending pin section 131 in which a chain fastener pin 135 is attached, with a first end link 137 of the chain 15 secured to the chain fastener pin 135 by passage of the chain fastener pin 135 through an opening 139 of the first end link 137 of chain 15.

In the embodiment illustrated in FIG. 8, an opening 14 is formed in the recessed portion 109 of the main circular gear plate 103 and the chain fastener pin 135, in addition to passing through the aperture 133 formed in the outwardly extending pin section 131 is also disposed in the opening 141, with the opening 141 in the main circular gear plate 103 being coaxial with the aperture 133 through the outwardly extending pin section 131. As shown in FIG. 8, an end 143 of the chain fastener pin 135 is secured in the opening 141 of the main circular gear plate 103, such as by welding, and the chain fastener pin 135 passes through the aperture 133 in the outwardly extending pin section 131, and is also secured in the opening 141.

In a preferred embodiment, the outwardly extending pin section 131 is secured to the square chain drum 17 or formed integrally therewith, and has a first flange 145 extending away from the drum 17 in a direction transverse to the longitudinal axis 117, and a chain seat 147 is provided that extends between the first flange 145 and the main circular gear plate 103. A second flange 149 (FIG. 9) may be provided, spaced from the first flange 145, which extends from the distal end 151 of the chain seat member 147 back towards the square chain drum 17, which second flange 149 is adjacent to and secured to the main circular gear plate 103, such as by welding. The chain seat member 147 has an inner surface 153 of an arcuate configuration, so as to accept a side section of a chain link therein. The second flange 149 has a terminus 155 which terminates short of the opening 141 in the main circular gear plate 103, so as not to interfere with placement and securement of the chain fastener pin 135.

The square chain drum 17 has an outer surface 157 which has a groove 159 therein for the acceptance of alternate links of a chain 15. The chain 15, for use with the main gear assembly as shown in FIG. 6, has alternate links 161 which lie in a substantially parallel relationship to each other, and intermediate links 163 at substantially right angles to the alternate links 161, with each link having side sections 165 and curved end sections 167. The groove 159 in the outer surface 157 of the square chain drum 17 is formed as a spiral groove, communicating with the chain seat member 147, extending from a location adjacent the one end 123 of the square chain drum 17 towards the opposite end 127 theroef. The recessed surface in the square chain drum 17 that forms the bottom wall 169 of the groove 159 has a concave configuration, so as to permit flush positioning of an arcuate side section 165 of the alternate chain links 161 thereon.

Figure 12:
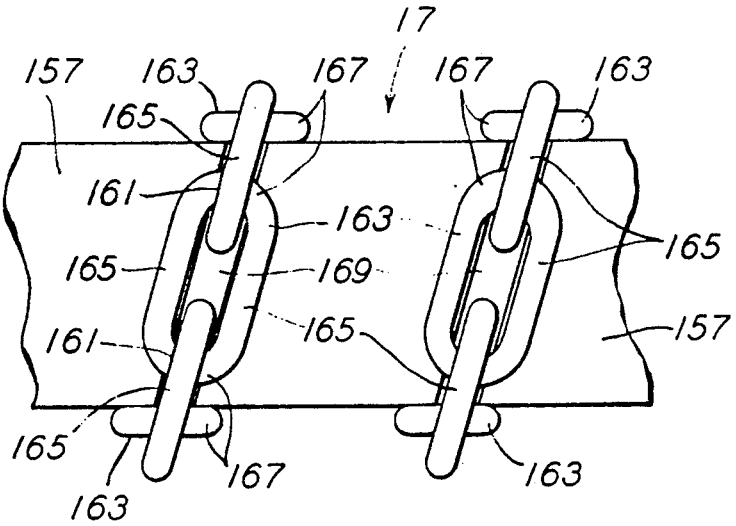
FIG. 12 is a diagrammatic plan view of the square chain drum of the main gear assembly of the railway car handbrake mechanism of the present invention showing the winding of a chain in the spiral groove of the drum with sections of the chain wound in a side-by-side relationship.
Figure 11:
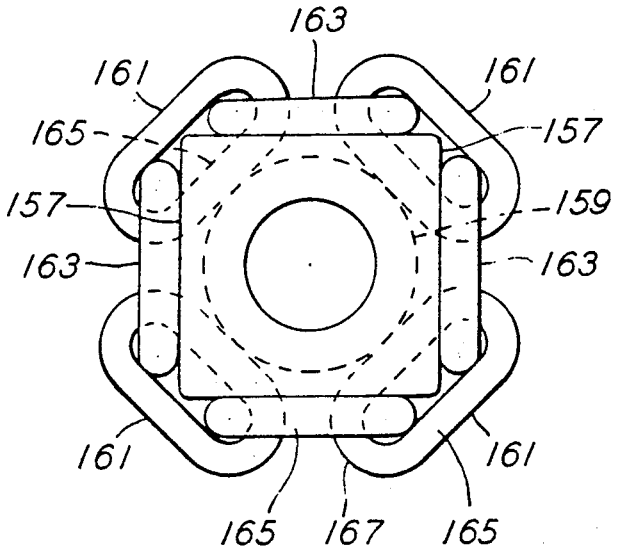
FIG. 11 is a diagrammatic end view of the square chain drum of the main gear assembly of the railway car handbrake mechanism of the present invention showing the winding of a section of chain thereon, with the placement of alternate and intermediate links of the chain about the drum.

Referring now to FIGS. 11 and 12, the non-kinking winding operation of a chain 15 on the square chain drum 17 is illustrated schematically. As seen in FIG. 11, the square chain drum 17 is constructed such that alternate links 161 of a chain 15 wound on the drum 17 are positioned with the side section 165 flush against the concave configuration of the bottom wall 169 of the groove 159, while intermediate links 163 of the chain 15 lie on the outer surface 157 of the square chain drum 17, at substantially right angles to the alternate links 161.

The use of the spiral groove 159 in the square chain drum 17 enables the winding of a plurality of turns of the chain 15 on the drum 17 without superimposing chain links 161 and 163 on one another. As shown in FIG. 12, only a single length of the chain 15 will be disposed in or above any one section of the groove 159 in the square chain drum 17. With use of the spiral groove 159, there will be no alternate link 161 superimposed on any other alternate link 161, or any other intermediate link 163, on the square chain drum 17 during winding of the chain 15, with chain 15 sections positioned in a side-by-side relationship along the longitudinal axis 117 of the square chain drum 17. There is, thus, no opportunity for links to interfere with other links during such winding and there is no possible slippage of any superimposed link relative to any underlying link of a chain as with previous chain winding drums.

As an example of the dimensions of a typical main gear assembly of the present invention, the main circular gear plate 103 would have an outside diameter of about 12 $\frac{1}{8}$ inches, a thickness at the recessed portion 109 of about $\frac{3}{8}$ inch and a thickness at the peripheral enlarged section 113 of about $\frac{3}{4}$ inch. The square chain drum 17 would have a thickness of about 2.5 inches and a length of about 4.60 inches, including the length of a 0.5 inch long reduced diameter trunion 121 which would have a diameter of about 2.09 inches. The shaft bore 119 has a diameter of about 1.315 inches. The chain 15, usable with the main gear assembly 101, is 7/16 inch Grade 70 Transport chain, the links of which are of a thickness of 0.468 inch and have an elliptical opening 0.62 inch wide by 1.325 inch long.

Figure 13:
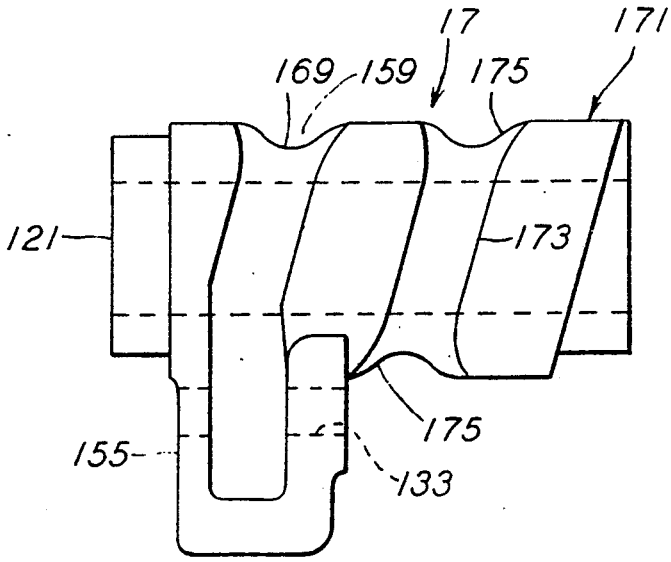
FIG. 13 an elevational view of another embodiment of the square chain drum of the railway car handbrake mechanism of the main gear assembly of FIG. 6 with a preferred groove configuration.

In a preferred embodiment, illustrated in FIG. 13, the groove 159 in the square chain drum 17 is wider at each of the corners 171 of the square chain drum 17 than at midpoints 173 forming each of the sides thereof. Also, preferably, the side walls 175 of the groove 159 have a slightly convex configuration so as to urge the side sections 165 of alternate links 161, which make contact therewith, into the concave configuration of the bottom wall 169 of the groove 159 upon winding of a chain 15 about the square chain drum 17. The depth of the groove 159 at the midpoints 173 of the sides of the square chain drum 17 should be that at least sufficient to accept an alternate link 161 to a depth that permits an intermediate link 163 to lie flush against the outer surface 157, while the width of the groove 159 should be at least sufficient to allow a side section of an alternate link 161 to lie flush in the concave bottom wall 169 of the groove 159 but of a width at least less than that which would permit an intermediate link 163 to enter the groove 159 when at substantially right angles to an alternate link.

Also, in accordance with the present invention, the trip cam has a particular configuration so as to enable quick and easy release of the trip bar, while also preventing disengagement of the operative connection between the flange on the pinion and the ratchet wheel when the trip cam is in non-operative position.

Referring now to FIGS. 14–17, the improved trip cam 181 is illustrated formed as a one-piece forged steel component. The trip cam 181 has a shaft 183 with a first journaled end 185 and a second journaled end 187, the journaled end 185 having a diameter smaller than the journaled end 187 and intermediate section 189 of the shaft 183. The shaft 183 has a longitudinal axis identified by the dashed line The end faces 191 and 193 of the journaled ends 185 and 187, respectively, are preferably smooth, but may have a slightly convex configuration. The first journaled end 185 has a non-circular configuration, with a flat face 195 provided, at least along a portion thereof and preferably completely along the journaled end 185. As illustrated, the first journaled end 185 is preferably of a d-shaped configuration, with the flat face 195 thereon. Provided that flat face 195 is provided, however, the first journaled end 185 may have other configurations, such as a triangle or a polygonal shape with other flat or rounded surfaces.

The trip cam 181 has, on the intermediate section 189 of the shaft 183, a cam arm 197 which extends radially outwardly from the intermediate section 189, the cam arm 197 preferably having an end surface 199, which preferably has a convex contour in a direction transverse the longitudinal axis a of the shaft 183. Spaced from the cam arm 197 on the intermediate section 189 of the shaft 103, there is provided a safety arm 201, which extends outwardly from the shaft 183, the safety arm 201 having an arcuate section 203, with a flared portion 205 at the outer end 207 thereof. The flared portion 205 has an upwardly extending shoulder 209 which extends back towards the shaft 183, the shoulder terminating in an end face 211.

Figure 16:
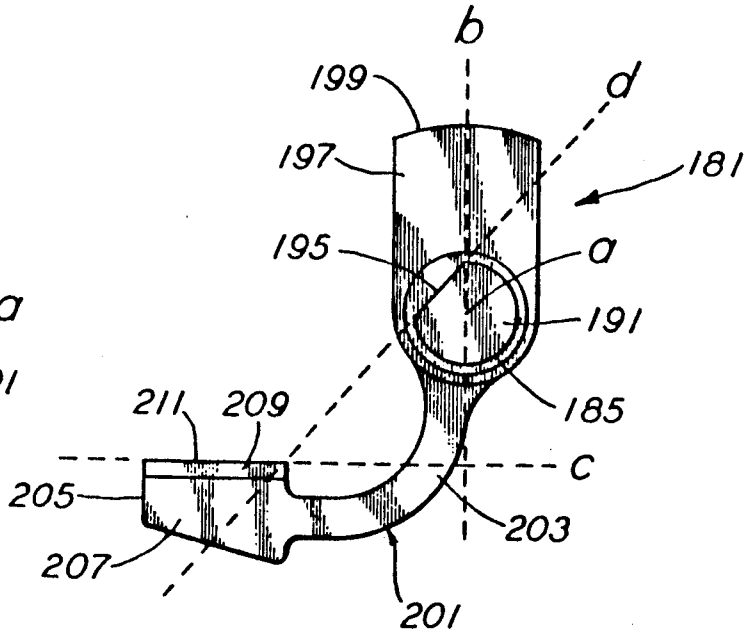
FIG. 16 is an end view of the trip cam of FIG. 14 looking towards the end of the first journaled end thereof.
Figure 14:
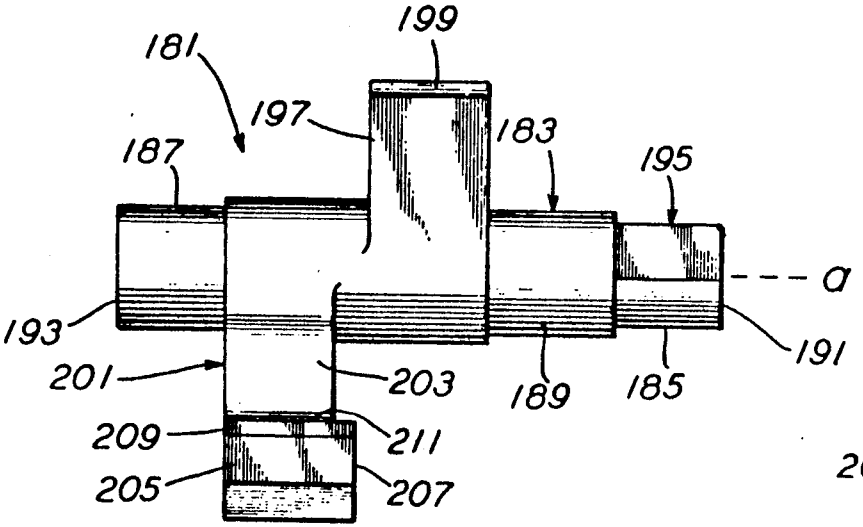
FIG. 14 is a side view of the trip cam of the railway car brake mechanism of the present invention.
Figure 17:
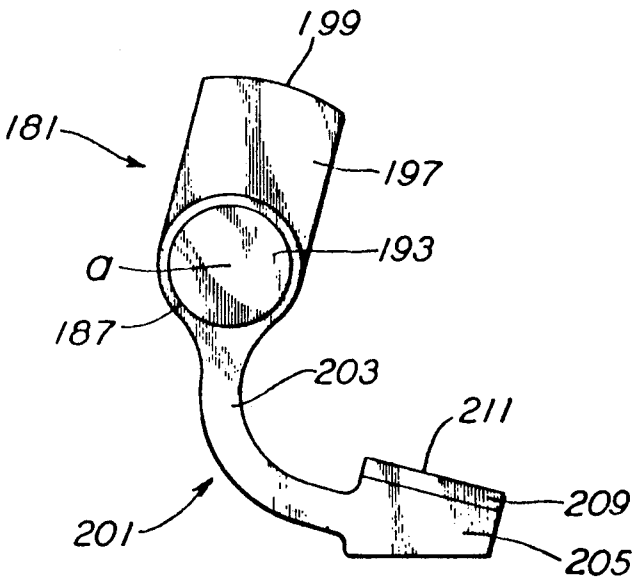
FIG. 17 is an end view of the trip cam of FIG. 14 looking towards the end of the second journaled end thereof.
Figure 15:
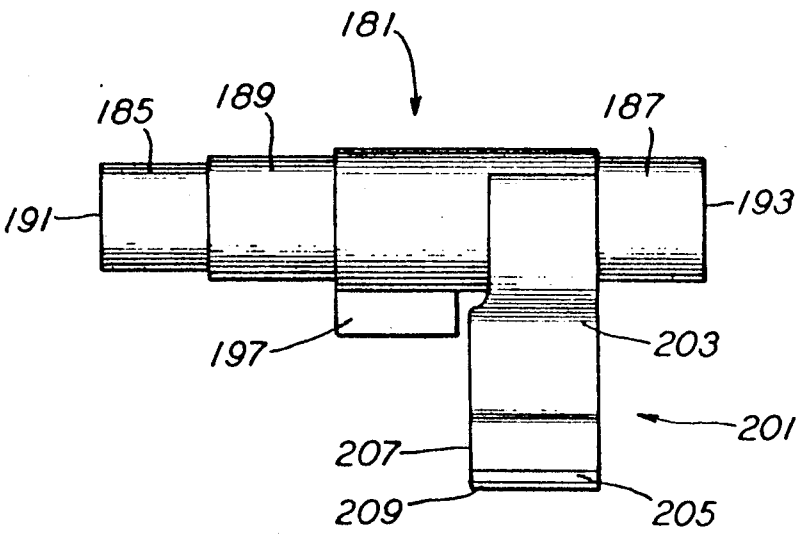
FIG. 15 is a bottom view of the trip cam of FIG. 14 rotated 180° from the position shown in FIG. 14.

The trip cam 181 is constructed to provide a substantially 85° to 95° angle, and most preferably a 90° angle between a first plane, drawn through the longitudinal center of the cam arm 197 and the longitudinal axis a of the shaft 183, identified by dashed line b in FIG. 16, and a second plane drawn along the end face 211 of the shoulder 209 of the flared portion 205 of the safety arm 201, identified by dashed line c in FIG. 16. As illustrated in FIG. 16, the flat face 195 along the first journaled end 185 of the shaft 183 is preferably disposed along a third plane, indicated by dashed line d, that is substantially 125° to 145°, and most preferably 135°, offset from the plane c drawn along the end face 211 of the shoulder 209 of the flared portion 205 of the safety arm 201.

The arcuate section of the safety arm of the trip cam is preferably formed by forming a safety arm as a relatively straight section and bending the safety arm to the correct arcuate form to provide the geometric shape that is required in the present trip cam.

The handbrake mechanism containing the above-described trip cam 181, allows for full release of the handbrake when the release or trip lever 87 is substantially parallel to the handbrake centerline and facilitates the return of the trip lever 87 after full release of the brakes. The arcuate section of the safety arm and geometric shape of the trip cam enables use of a simplified trip lever 87 for the brakes in place of more complicated previous assemblies.

Figure 3:
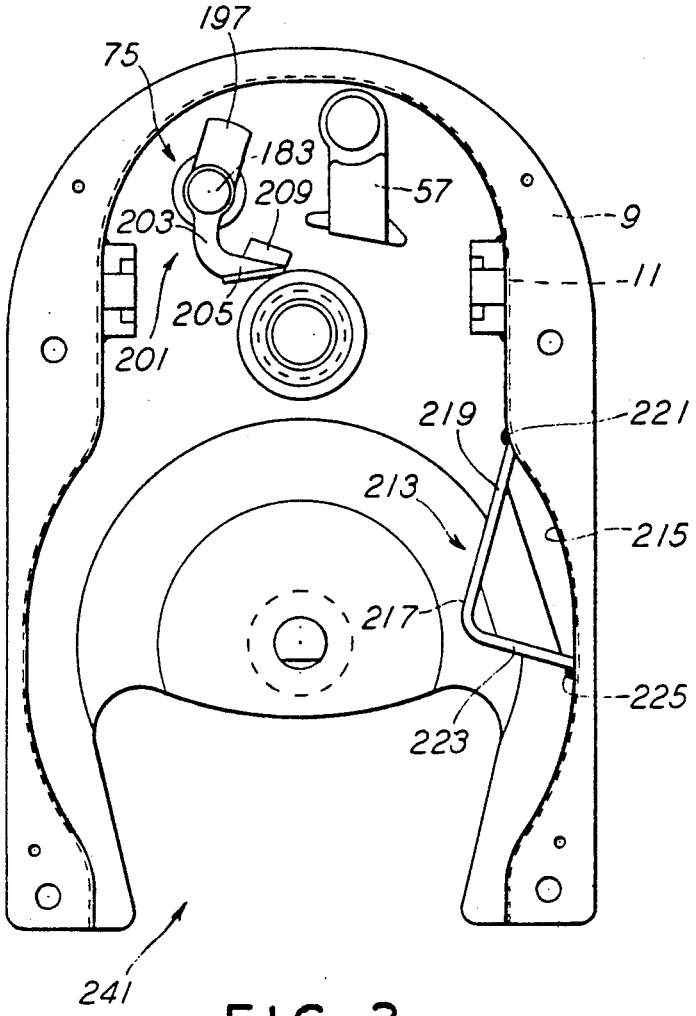
FIG. 3 is a rear view of the front wall of the cover of the handbrake mechanism with certain internal components in place.
Figure 4:
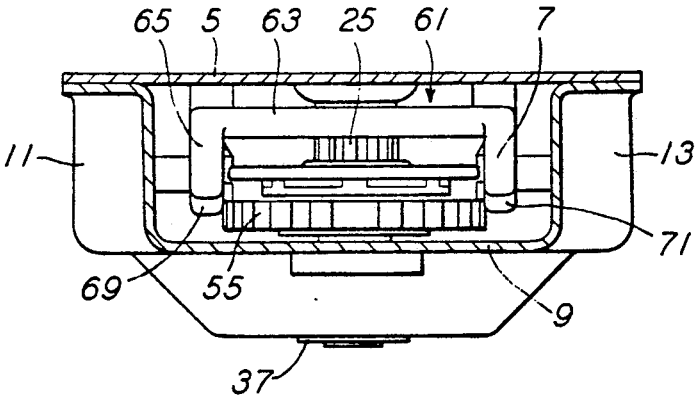
FIG. 4 is a view taken along lines IV—IV of the FIG. 1.
Figure 5:
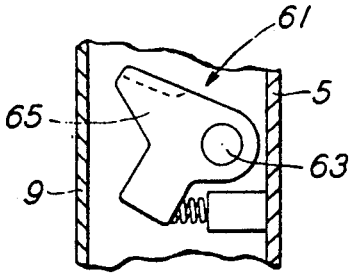
FIG. 5 is a vertical sectional view taken along lines V—V of FIG. 1.

In the embodiment of the handbrake mechanism for railway cars shown in FIGS. 1–17, a chain stop 213 is secured to the inner surface 215 of a side wall 11 of the cover 7, which prevents winding of the chain 15 in the wrong direction on square chain drum 17. The chain stop 213, as illustrated, comprises an L-shaped bracket 217 with a long leg 219 welded at 221 to the inner surface 215 of the wall 11 and a short leg 223 welded at 225 also to the inner surface 215 of the wall 11 (FIG. 3).

Figure 18:
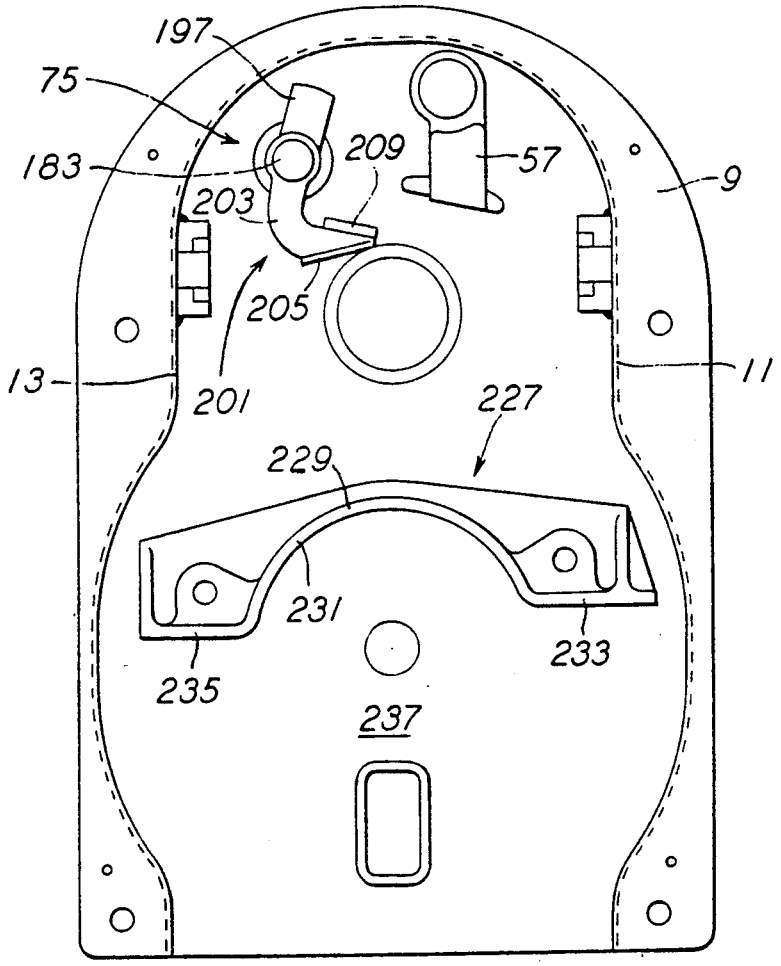
FIG. 18 is a rear view of the front wall of an alternate embodiment of the cover of a handbrake mechanism of the present invention with certain internal components in place.

In another embodiment shown in FIG. 18, a chain guard 227 is provided, spaced from and disposed above the square chain drum 17, in lieu of the chain stop 213. The chain guard 227 comprises a plate 229 that has an arcuate section 231 and two end support sections 233 and 235, which chain guard 22 is secured to the inner surface 237 of the front wall 9 of cover 7, such as by bolts or other fastening means. The arcuate section 231 overlies the area of the square chain drum 17. Also, in the embodiment shown in FIG. 18, the front wall 9 of the cover 7 extends to the bottom of side walls 11 and 13 and extends across the spacing between the side walls, while in the embodiment of FIGS. 1–17, the front wall 9 of the cover 7 has an opening 241 exposing a portion of the chain 15 when wound on square chain drum 17.

What is claimed is:

1. In a handbrake mechanism for a railway car, where a hand wheel is used to rotate a gear wheel to apply the brakes, having a housing with a back wall and a front wall, with a chain winding drum and a main gear wheel rotatably mounted on a drum shaft thereon, a hand wheel shaft rotatably mounted on said housing having a bearing section at a first end and a hand wheel receiving section on a second end external to said housing, a ratchet wheel rotatable with said hand wheel shaft intermediate said first and second ends thereof, a pawl in said housing which cooperates with said ratchet wheel so as to prevent reverse rotation thereof, a freely rotatable pinion on said hand wheel shaft and engaging said main gear wheel, said pinion having a radially extending flange cooperating therewith, a disengageable driving connection between said flange and said ratchet wheel, a trip cam rotatably mounted in said housing, a trip bar operable by said trip cam which cooperates with said flange to move said flange to disengage said driving connection and permit said pinion to freely rotate to release said main gear wheel for rotation in a brake releasing direction accompanied by release of said chain winding drum and a chain wound thereon; the improvement wherein:

said main gear wheel and chain winding drum comprise a main gear assembly having;

a main circular gear plate having gear teeth about a circumference thereof and a central passageway therethrough;

a substantially square chain drum, adapted for winding thereon of said chain of said main gear assembly, having a longitudinal axis and a coaxial reduced diameter trunion at one end thereof, secured in said central passageway of said main circular gear plate, a shaft bore therethrough along said longitudinal axis, and an opposite end;

an outwardly extending pin section extending away from said square chain drum in a direction transverse to said longitudinal axis, said outwardly extending pin section having an aperture therethrough substantially parallel to said longitudinal axis of said square chain drum;

said chain having alternate links lying in a substantially parallel relation and intermediate links at substantially right angles to said alternate links, and having a first end link; and a chain fastener pin passing through said first end link of said chain to attach said chain to said main gear assembly, said chain fastener pin secured in said aperture of said outwardly extending pin section with said first end link secured between said outwardly extending pin section and said main circular gear plate, whereby rotation of said main gear wheel effects winding of said chain about said square chain drum; and wherein said trip cam comprises a shaft, having a longitudinal axis, with first and second journaled ends and an intermediate section, having;

a cam arm extending radially outwardly from said intermediate section; and a safety arm extending outwardly from the intermediate section, spaced from said cam arm, said safety arm having a flared portion on the end thereof providing an end face;

said trip cam constructed to provide a substantially 85° to 95° angle between a first plane drawn through the longitudinal center of said cam arm and said longitudinal axis of said shaft, and a second plane drawn along the end face of a shoulder of the flared portion of the end of said safety arm.

2. In a handbrake mechanism for a railway car as defined in claim 1, the improvement wherein said housing has a cover with a front wall, said front wall has an upper front wall section through which an outer end of said hand wheel shaft extends, an intermediate front wall section extending outwardly therefrom, and a downwardly extending lower front wall section extending from said intermediate front wall section.

3. In a handbrake mechanism for a railway car as defined in claim 2, the improvement wherein said drum shaft extends between said back wall and said lower front wall section of said housing.

4. In a handbrake mechanism for a railway car as defined in claim 3, the improvement wherein said trip cam has a shaft with a journaled forward end which extends through said upper front wall section of said front wall, and a manually operable trip lever is mounted thereon, said trip lever having a horizontal portion mounted on said journaled forward end and an enlarged grip portion at the end thereof.

5. In a handbrake mechanism for a railway car as defined in claim the improvement wherein said main circular gear plate has an opening therein, coaxial with said aperture through said outwardly extending pin section, and an end of said chain fastener pin is secured in said opening in said main circular plate.

6. In a handbrake mechanism for a railway car as defined in claim 5, the improvement wherein said outwardly extending pin section is formed as a single piece unit with said square chain drum.

7. In a handbrake mechanism for a railway car as defined in claim 1, the improvement wherein said outwardly extending pin section comprises a first flange extending away from said drum in a direction transverse to said longitudinal axis, and a chain seat member extending between said first flange and said main circular gear plate.

8. In a handbrake mechanism for a railway car as defined in claim 7, the improvement wherein said chain seat member has an inner surface of an arcuate configuration, so as to accept a side section of a chain link therein.

9. In a handbrake mechanism for a railway car as defined in claim 7, the improvement wherein said outwardly extending pin section comprises said first flange extending away from said drum in a direction transverse to said longitudinal axis, and a second flange, spaced from said first flange, extending from said distal end of said chain seat member, said second flange aligned with said first flange and extending towards said square chain drum adjacent said main circular gear plate.

10. In a handbrake mechanism for a railway car as defined in claim 9, the improvement wherein said second flange is secured to said main circular gear plate.

11. In a handbrake mechanism for a railway car as defined in claim 1, the improvement wherein said square chain drum has an outer surface with said groove provided in said outer surface for acceptance of alternate links of said chain.

12. In a handbrake mechanism for a railway car as defined in claim 11, the improvement wherein said groove in said outer surface of said square chain drum is formed as a spiral groove extending from a location adjacent said one end of said square chain drum towards said opposite end.

13. In a handbrake mechanism for a railway car as defined in claim 12, the improvement wherein said groove in said square chain drum is wider at each corner of said square chain drum than at midpoints of each side thereof.

14. In a handbrake mechanism for a railway car as defined in claim 13, the improvement wherein sidewalls forming said groove in said square chain drum have a convex configuration.

15. In a handbrake mechanism for a railway car as defined in claim 12, the improvement wherein a recessed surface of said square drum which forms a bottom wall of said groove has a concave configuration so as to permit flush positioning of side section of alternate links of said chain thereon.

16. In a handbrake mechanism for a railway car as defined in claim 15, the improvement wherein said alternate links of said chain, when wound thereon, are positioned flush against said concave configuration of said bottom wall of said groove while intermediate links of said attached chain lie on said outer surface of said square chain drum, at substantially right angles to said alternate links.

17. In a handbrake mechanism for a railway car as defined in claim the improvement wherein the first journaled end of said trip cam has a non-circular configuration with a flat face along at least a portion thereof.

18. In a handbrake mechanism for a railway car as defined in claim the improvement wherein said trip cam has a substantially 90° angle provided between said first plane and said second plane.

19. In a handbrake mechanism for a railway car as defined in claim 18, the improvement wherein a flat face along the first journaled end of said trip cam is disposed along a third plane that is substantially 125° to 145° offset from the second plane drawn along the end face of said shoulder of said flared portion of the end of said safety arm.

20. In a handbrake mechanism for a railway car as defined in claim 19, the improvement wherein the flat face along the journaled end of said trip cam is disposed along a third plane substantially 135° offset from said second plane.

21. In a handbrake mechanism for a railway car as defined in claim 1, the improvement wherein said cam arm on said trip cam has an end surface and said end surface has a convex contour in a direction transverse the longitudinal axis of said shaft.

22. In a handbrake mechanism for a railway car as defined in claim 1, the improvement wherein said trip cam is formed as a one piece forged steel component.

23. In a handbrake mechanism for a railway car as defined in claim 1, the improvement wherein said housing has a cover with spaced side walls and a front wall, said front wall has an opening exposing a portion of the chain when wound on square chain drum, and a chain stop is provided, secured to an inner surface of a said side wall.

24. In a handbrake mechanism for a railway car as defined in claim 23, the improvement wherein said chain stop comprises a L-shaped bracket having a long leg and a short leg, which legs are secured to said side wall.

25. In a handbrake mechanism for a railway car as defined in claim 1, the improvement wherein said housing has a cover with spaced side walls and a front wall, said front wall extends to the bottom of said side walls and across the spacing between said side walls, and a chain guard is provided spaced from and disposed above said square chain drum.

26. In a handbrake mechanism for a railway car as defined in claim 25, the improvement wherein said chain guard is secured to the inside surface of said front wall and comprises a plate having two end support sections and an arcuate section, and said arcuate section overlies the area of said square chain drum.

27. In a handbrake mechanism for a railway car where a hand wheel is used to rotate a gear wheel to apply the brakes, having a housing with a back wall and a front wall, with a chain winding drum and a main gear wheel rotatably mounted on a drum shaft thereon, a hand wheel shaft rotatably mounted on said housing having a bearing section at a first end and a hand wheel receiving section on a second end external to said housing, a ratchet wheel rotatable with said hand wheel shaft intermediate said first and second ends thereof, a pawl in said housing which cooperates with said ratchet wheel so as to prevent reverse rotation thereof, a freely rotatable pinion on said hand wheel shaft and engaging said main gear wheel, said pinion having a radially extending flange cooperating therewith, a disengageable driving connection between said flange and said ratchet wheel, a trip cam rotatably mounted in said housing, a trip bar operable by said trip cam which cooperates with said flange to move said flange to disengage said driving connection and permit said pinion to freely rotate to release said main gear wheel for rotation in a brake releasing direction accompanied by release of said chain winding drum and a chain wound thereon; the improvement wherein:

said housing has a cover with a front wall, said front wall has an upper front wall section through which an end of said hand wheel shaft extends, an intermediate front wall section extending outwardly therefrom, and a downwardly extending lower front wall section extending from said intermediate front wall section;

said drum shaft extends between said back wall and said lower front wall section of said housing; and said main gear and chain winding drum comprise a main gear assembly having;

a main circular gear plate having gear teeth about a circumference thereof and a central passageway therethrough;

a substantially square chain drum, adapted for winding thereon of said chain of said main gear assembly, having a longitudinal axis and a coaxial reduced diameter trunion at one end thereof, secured in said central passageway of said main circular gear plate, a shaft bore therethrough along said longitudinal axis, and an opposite end;

an outwardly extending pin section extending away from said square chain drum in a direction transverse to said longitudinal axis, said outwardly extending pin section having an aperture therethrough substantially parallel to said longitudinal axis of said square chain drum;

said chain having alternate links lying in a substantially parallel relation and intermediate links at substantially right angles to said alternate links, and having a first end link; and a chain fastener pin passing through said first end link of said chain to attach said chain to said main gear assembly, said chain fastener pin secured in said aperture of said outwardly extending pin section with said first end link secured between said outwardly extending pin section and said main gear wheel effects winding of said chain about said square chain drum; and wherein said trip cam comprises:

a shaft, having a longitudinal axis, with first and second journaled ends and an intermediate section, said first journaled end having a non-circular configuration with a flat face along at least a portion thereof;

a cam arm extending radially outwardly from said intermediate section; and a safety arm extending outwardly from the intermediate section, spaced from said cam arm, said safety arm having a flared portion on the end thereof with a shoulder thereon providing an end face;

said trip cam means constructed to provide a substantially 85° to 95° angle between a first plane drawn through the longitudinal center of said cam arm and said longitudinal axis of said shaft, and a second plane drawn along the end face of the shoulder of the flared portion of the end of said safety arm, and wherein said flat face along said first journaled end of said trip cam is disposed along a third plane that is substantially 135° offset from the second plane drawn along the end face of said shoulder of said flared portion of the end of said safety arm.

28. In a handbrake mechanism for a railway car as defined in claim 27, the improvement wherein said main circular gear plate has an opening therein, coaxial with said aperture through said outwardly extending pin section, and an end of said chain fastener pin is secured in said opening in said main circular gear plate.

29. In a handbrake mechanism for a railway car as defined in claim 27, the improvement wherein said trip cam has a shaft with a journaled forward end which extends through said upper front wall section of said front wall, and a manually operable trip lever is mounted thereon, said trip lever having a horizontal portion mounted on said journaled forward end and an enlarged grip portion of the end thereof.

30. In a handbrake mechanism for a railway car as defined in claim 27, the improvement wherein said outwardly extending pin section is formed as a single piece unit with said square chain drum.

31. In a handbrake mechanism for a railway car as defined in claim 27, the improvement wherein said outwardly extending pin section comprises a first flange extending away from said square chain drum in a direction transverse to said longitudinal axis, and a chain seat member extending between said first flange and said main circular gear plate.

32. In a handbrake mechanism for a railway car as defined in claim 31, the improvement wherein said chain seat member has an inner surface of an arcuate configuration, so as to accept a side section of link of such chain therein.

33. In a handbrake mechanism for a railway car as defined in claim 31, the improvement wherein said outwardly extending pin section comprises first flange extending away from said drum in a direction transverse to said longitudinal axis, and a second flange, spaced from said first flange, extending from said distal end of said chain seat member, aligned with said first flange, and extending towards said square chain drum adjacent said main circular gear plate.

34. In a handbrake mechanism for a railway car as defined in claim 33, the improvement wherein said second flange is secured to said main circular gear plate.

35. In a handbrake mechanism for a railway car as defined in claim 27, the improvement wherein said square chain drum has an outer surface with said groove provided in said outer surface for acceptance of alternate links of such chain.

36. In a handbrake mechanism for a railway car as defined in claim 35, the improvement wherein said groove in said outer surface of said square chain drum is formed as a spiral groove extending from a location adjacent said one end of said square chain drum towards said opposite end.

37. In a handbrake mechanism for a railway car as defined in claim 36, the improvement wherein said groove in said square chain drum is wider at each corner of said square chain drum than at midpoints of each side thereof.

38. In a handbrake mechanism for a railway car as defined in claim 37, the improvement wherein the sidewalls forming said groove in said square chain drum have a convex configuration.

39. In a handbrake mechanism for a railway car as defined in claim 27, the improvement wherein a recessed surface of said square drum which forms a bottom wall of said groove has a convex configuration so as to permit flush positioning of a side section of alternate links of such chain thereon.

40. In a handbrake mechanism for a railway car as defined in claim 39, the improvement wherein said alternate links of such chain, to be wound on said square chain drum, when wound thereon, are positioned flush against said concave configuration of said bottom wall of said groove, while alternate links of said attached chain lie on said outer surface of said square chain drum at substantially right angles to said alternate links.

41. In a handbrake mechanism for a railway car as defined in claim 27, the improvement wherein said cam arm has an end surface and said end surface has a convex contour in a direction transverse the longitudinal axis of said shaft.

42. In a handbrake mechanism for a railway car as defined in claim 27, the improvement wherein said trip cam has a substantially 90° angle provided between said first plane and said second plane.

43. In a handbrake mechanism for a railway car as defined in claim 42, the improvement wherein the flat face along the journaled end of said trip cam is disposed along a third plane substantially 135° offset from said second plane.

44. In a handbrake mechanism for a railway car as defined in claim 27, the improvement wherein said trip cam is formed as a one piece forged steel component.

45. In a handbrake mechanism for a railway car as defined in claim 27, the improvement wherein spaced side walls are provided on said housing between said front wall of said cover and said back wall, and a chain stop is provided, secured to a inner surface of a said side wall.

46. In a handbrake mechanism for a railway car as defined in claim 45, the improvement wherein said chain stop comprises an L-shaped bracket having a long leg and a short leg, which legs are secured to said side wall.

47. In a handbrake mechanism for a railway car where a hand wheel is used to rotate a gear wheel to apply the brakes, having a housing with a back wall and a front wall, with a chain winding drum and a main gear wheel rotatably mounted on a drum shaft thereon, a hand wheel shaft rotatably mounted on said housing having a bearing section at a first end and a hand wheel receiving section on a second end external to said housing, a ratchet wheel rotatable with said hand wheel shaft intermediate said first and second ends thereof, a pawl in said housing which cooperates with said ratchet wheel so as to prevent reverse rotation thereof, a freely rotatable pinion on said hand wheel shaft and engaging said main gear wheel, said pinion having a radially extending flange cooperating therewith, a disengageable driving connection between said flange and said ratchet wheel, a trip cam rotatably mounted in said housing, a trip bar operable by said trip cam which cooperates with said flange to move said flange to disengage said driving connection and permit said pinion to freely rotate to release said main gear wheel for rotation in a brake releasing direction accompanied by release of said chain winding drum and a chain wound thereon; the improvement wherein:

said housing has a cover with a front wall and spaced side walls, with said front wall extending to the bottom of said side walls and across the spacing between said side walls;

said drum shaft extends between said back wall and said front wall of said housing;

a chain guard is provided spaced from and disposed above said chain winding drum; and said main gear and chain winding drum comprise a main gear assembly having;

a main circular gear plate having gear teeth about a circumference thereof and a central passageway therethrough;

a substantially square chain drum, adapted for winding thereon of said chain of said main gear assembly, having a longitudinal axis and a coaxial reduced diameter trunion at one end thereof, secured in said central passageway of said main circular gear plate, a shaft bore therethrough along said longitudinal axis, and an opposite end;

an outwardly extending pin section extending away from said square chain drum in a direction transverse to said longitudinal axis, said outwardly extending pin section having an aperture therethrough substantially parallel to said longitudinal axis of said square chain drum;

said chain having alternate links lying in a substantially parallel relation and intermediate links at substantially right angles to said alternate links, and having a first end link; and a chain fastener pin passing through said first end link of said chain to attach said chain to said main gear assembly, said chain fastener pin secured in said aperture of said outwardly extending pin section with said first end link secured between said outwardly extending pin section and said main gear wheel effects winding of said chain about said square chain drum; and wherein said trip cam comprises:

a shaft, having a longitudinal axis, with first and second journaled ends and an intermediate section, said first journaled end having a non-circular configuration with a flat face along at least a portion thereof;

a cam arm extending radially outwardly from said intermediate section; and a safety arm extending outwardly from the intermediate section, spaced from said cam arm, said safety arm having a flared portion on the end thereof with a shoulder thereon providing an end face;

said trip cam means constructed to provide a substantially 85° to 95° angle between a first plane drawn through the longitudinal center of said cam arm and said longitudinal axis of said shaft, and a second plane drawn along the end face of the shoulder of the flared portion of the end of said safety arm, and wherein said flat face along said first journaled end of said trip cam is disposed along a third plane that is substantially 135° offset from the second plane drawn along the end face of said shoulder of said flared portion of the end of said safety arm.

48. In a handbrake mechanism for a railway car as defined in claim 47, the improvement wherein said chain guard is secured to the inside surface of said front wall and comprises a plate having two end support sections and an arcuate section, and said arcuate section overlies the area of said square chain drum.

* * * * *

UNITED STATES PATENT AND TRADEMARK OFFICE

CERTIFICATE OF CORRECTION

PATENT NO. : 5,127,283

DATED : July 7, 1992

INVENTOR(S) : Raymond O'Brien, et al

It is certified that error appears in the above-identified patent and that said Letters Patent is hereby corrected as shown below:

Column 2, line 9, delete "blange" and insert --flange--.

Column 6, line 35, delete "4" and insert --49--.

Column 8, line 19, delete "14" and insert --141--;

Column 8, line 54, after assembly, insert --1--.

Column 10, line 10, after line, insert --a--.

Column 12, line 44, after Claim, insert --1,--.

Column 13, line 34, after of, first occurence, insert --a--;

Column 13, line 45, after Claim, insert --1,--;

Column 13, line 49, after Claim, insert --1,--.

Signed and Sealed this

Fifth Day of October, 1993

Bruce Lehman

*Attest:*

BRUCE LEHMAN

*Attesting Officer*

*Commissioner of Patents and Trademarks*